US009163797B2

(12) United States Patent
Sun et al.

(10) Patent No.: US 9,163,797 B2
(45) Date of Patent: Oct. 20, 2015

(54) ATMOSPHERE LIGHT WITH INTERACTING FUNCTIONS

(75) Inventors: Ching-Cherng Sun, Yangmei (TW); Yeh-Wei Yu, Hukou Township (TW); Yu-Huan Wang, Taichung (TW)

(73) Assignee: National Central University, Zhongli (TW)

( * ) Notice: Subject to any disclaimer, the term of this patent is extended or adjusted under 35 U.S.C. 154(b) by 549 days.

(21) Appl. No.: 13/400,115

(22) Filed: Feb. 19, 2012

(65) Prior Publication Data

US 2013/0120989 A1 May 16, 2013

(30) Foreign Application Priority Data

Nov. 16, 2011 (TW) ..... 100141969 A

(51) Int. Cl.

| | |
|---|---|
| ***F21V 21/00*** | (2006.01) |
| ***F21S 10/02*** | (2006.01) |
| ***F21S 2/00*** | (2006.01) |
| ***F21V 15/01*** | (2006.01) |
| ***F21V 23/04*** | (2006.01) |
| *A63B 43/06* | (2006.01) |
| *F21W 121/00* | (2006.01) |
| *F21Y 101/02* | (2006.01) |
| *A63B 24/00* | (2006.01) |
| *A63B 39/06* | (2006.01) |
| *A63B 39/00* | (2006.01) |

(52) U.S. Cl.

CPC ..... *F21S 10/02* (2013.01); *F21S 2/005* (2013.01); *F21V 15/01* (2013.01); *F21V 23/0435* (2013.01); *F21V 23/0464* (2013.01); *A63B 24/00* (2013.01); *A63B 39/06* (2013.01); *A63B 43/06* (2013.01); *A63B 2039/003* (2013.01); *A63B 2209/08* (2013.01); *A63B 2220/801* (2013.01); *A63B 2220/803* (2013.01); *A63B 2220/805* (2013.01); *A63B 2220/808* (2013.01); *A63B 2220/833* (2013.01); *A63B 2225/50* (2013.01); *F21W 2121/00* (2013.01); *F21Y 2101/02* (2013.01)

(58) Field of Classification Search

CPC ..... F21Y 2105/003; F21Y 2111/004; F21Y 2111/001; F21Y 2111/002; F21Y 2111/005; F21Y 2111/007

USPC ..... 362/249.06, 249.14, 249.16

See application file for complete search history.

(56) References Cited

U.S. PATENT DOCUMENTS

| | | | | |
|---|---|---|---|---|
| 6,746,131 | B1 * | 6/2004 | Goldstein et al. | 362/96 |
| 6,851,831 | B2 * | 2/2005 | Karlicek, Jr. | 362/249.06 |
| 2007/0177381 | A1 * | 8/2007 | Kwiatt, III | 362/252 |
| 2011/0058370 | A1 * | 3/2011 | Datz et al. | 362/235 |
| 2011/0193467 | A1 * | 8/2011 | Grajcar | 313/113 |

* cited by examiner

*Primary Examiner* — William Carter

(74) *Attorney, Agent, or Firm* — Rosenberg, Klein & Lee

(57) ABSTRACT

An atmosphere light with interacting functions includes a body formed with a plurality of polygon-shaped blocks which are connected to each other, a plurality of lenses respectively covering the blocks, a receiving space defined between the lens and the block, a light source located in the receiving space and mounted at the center on the bottom of the block, a cover assembled in the receiving space and covering the light source, a controller assembled in the body and electrically connected to the light source so that the light source is varied by the controller. Under this arrangement, when the light beams from the light source are transmitted to the lenses, the light beams are refracted by the lenses and passes through the lenses; consequently, the light beam is formed as a virtual image at the center of the body via the refraction.

12 Claims, 10 Drawing Sheets

ATMOSPHERE LIGHT WITH INTERACTING FUNCTIONS

BACKGROUND OF THE INVENTION

1. Field of the Invention

The present invention relates to an atmosphere light, and more particularly to an atmosphere light with interacting functions.

2. Description of Related Art

A conventional atmosphere light comprises a body, at least one light transmitting gateway and a light source. The body has a optical-transparent area. The light transmitting gateway is defined in the body. The light source is mounted in the body and corresponding to the light transmitting gateway. Each light transmitting gateway is predefined as a pattern, so that after a plurality of light beams from the light source is reflected by the light transmitting gateway, the pattern is performed by these light beams. Under this arrangement, when the light beams from the light source is transmitted to the light transmitting gateway, the light beams is reflected by the light transmitting gateway toward the optical-transparent area and passes through the optical-transparent area toward the air. Therefore, the atmosphere light performs various light patterns and illumination from the light transmitting gateway.

However, the conventional atmosphere light has one shortcoming as following:

The conventional atmosphere light has no interacting functions. For example, the pattern of the light beams from the conventional atmosphere light cannot vary with the voice command, shock, or light and shadows.

The present invention has arisen to mitigate and/or obviate the disadvantages of the conventional. Further benefits and advantages of the present invention will become apparent after a careful reading of the detailed description with appropriate reference to the accompanying drawings.

SUMMARY OF THE INVENTION

The main objective of the present invention is to provide an improved atmosphere light.

To achieve the objective, an atmosphere light with interacting functions comprises a body formed with a plurality of polygon-shaped blocks which are connected to each other, a plurality of lenses respectively covering the blocks, between each pair of block and lens having a receiving space defined therein, a light source located in the receiving space, the light source mounted at the center on the bottom of the block, a cover assembled in the receiving space and covering the light source, a controller assembled in the body, the controller electrically connected to the light source so that the light source is varied by the controller.

Wherein the lenses allows the light to transmit without impediment so that the lenses can be replaced by convex lenses, concave lenses, combination of convex and concave lenses, transparent plastics or thin papers; the body might be tetrahedron-shaped, octahedron-shaped or buckyball; the blocks are formed as regular polygons with four sides to twenty sides; the blocks are made of plastic, iron sheet or magnetic materials; the light sources might be LEDs, fluorescent lamps or bulb; a plurality of programs is written into the controller for controlling the light source such as transmitting the light beams or not, changing the color of the light beams or adjusting the illumination of the light beams; the controller might control the light source via a switch, a remote controller, a voice-identified controller, an applause controller or a wire controller so as to vary the light beams from the light sources; a microphone is assembled in the body; the microphone receives the outside voice and transmits the receiving message to the controller so that the controller controls the light sources according to the outside voice; a low-pass filter is mounted in the body; the outside ambience is filtered by the low-pass filter so that the microphone receives the clear voice command finally; a shock sensor is mounted in the body; the shock sensor receives the outside shocks and transmits the received message to the controller so that the controller controls the light sources according to the frequency or the amplitude of the outside shocks; an ambient light photo sensor is mounted in the body; when the user is close to the lenses of the body, partial light is shaded by the user so that the ambient light photo sensor receives an information about shadows and lights from the user and transmits the received message to the controller; therefore, the controller controls the single light sources 14 according to the user closing to the lenses of the body or not; the cover in the receiving space might be a diffusing sheet, an acrylic sheet or a glass sheet so as to refract the light beams from the light source by the refracting index corresponding to the cover.

Under this arrangement, when the plurality of light beams from the light source is transmitted to the lenses, the light beams are refracted by the lenses and passes through the lenses; consequently, the light beam is formed as a virtual image at the center of the body via the refraction; the light source is further controlled by the controller so that the light source transmits the light beams in various ways according to the controller.

Further benefits and advantages of the present invention will become apparent after a careful reading of the detailed description with appropriate reference to the accompanying drawings.

DETAILED DESCRIPTION OF THE INVENTION

Figure 1:
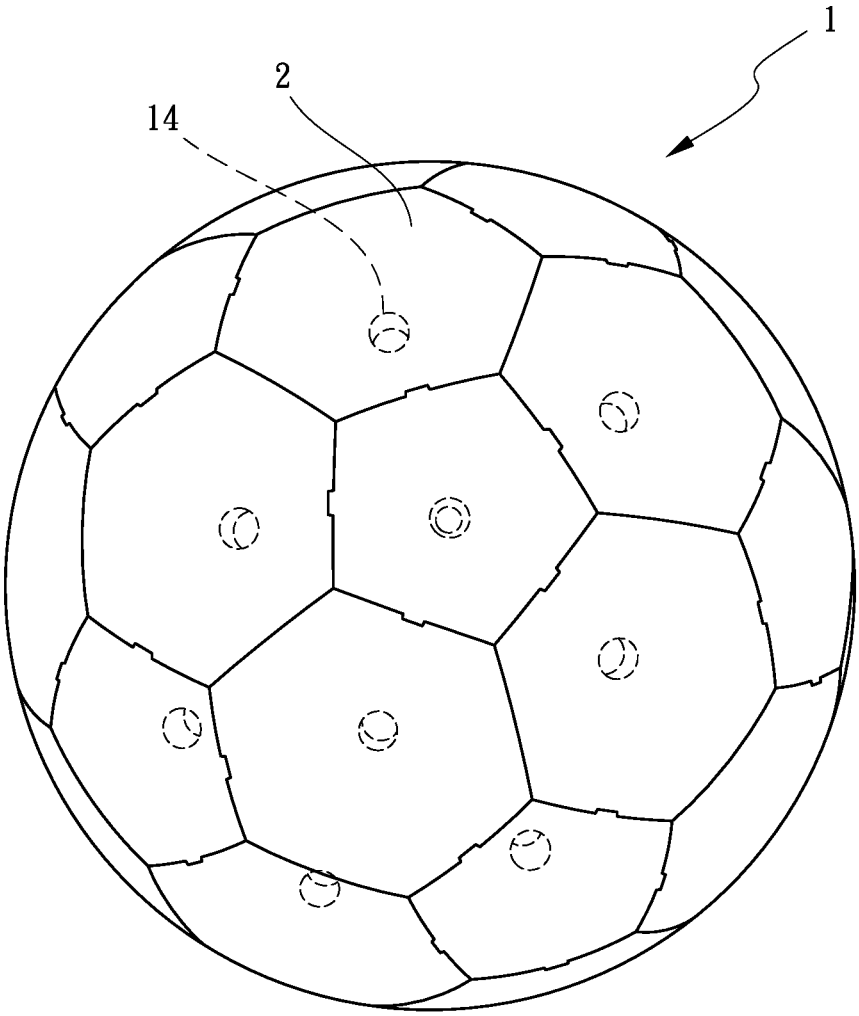
FIG. 1 is an assembled view of an atmosphere light with interacting functions of the present invention.
Figure 2:
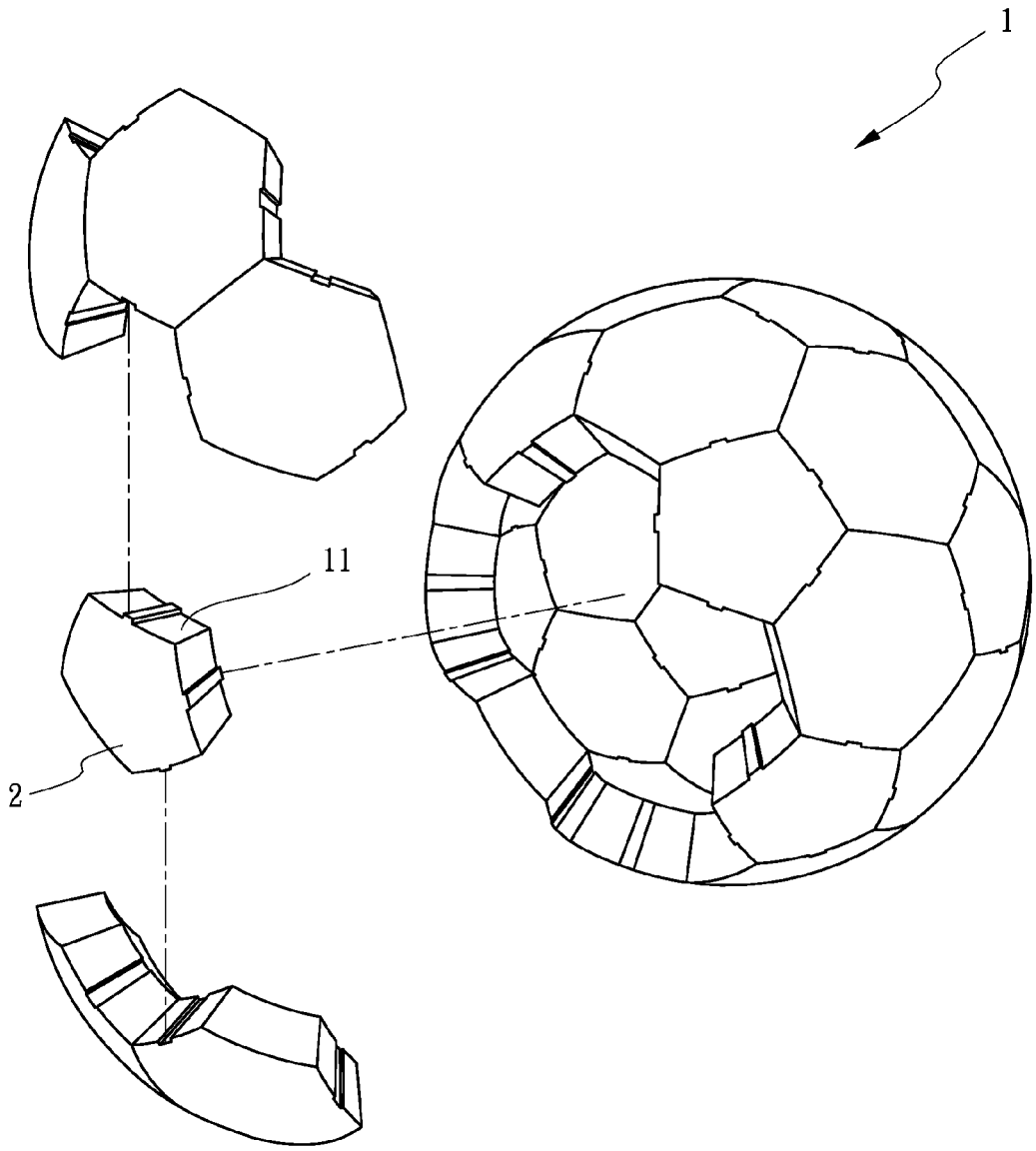
FIG. 2 is a partially exploded view of the atmosphere light with interacting functions of the present invention.
Figure 3:
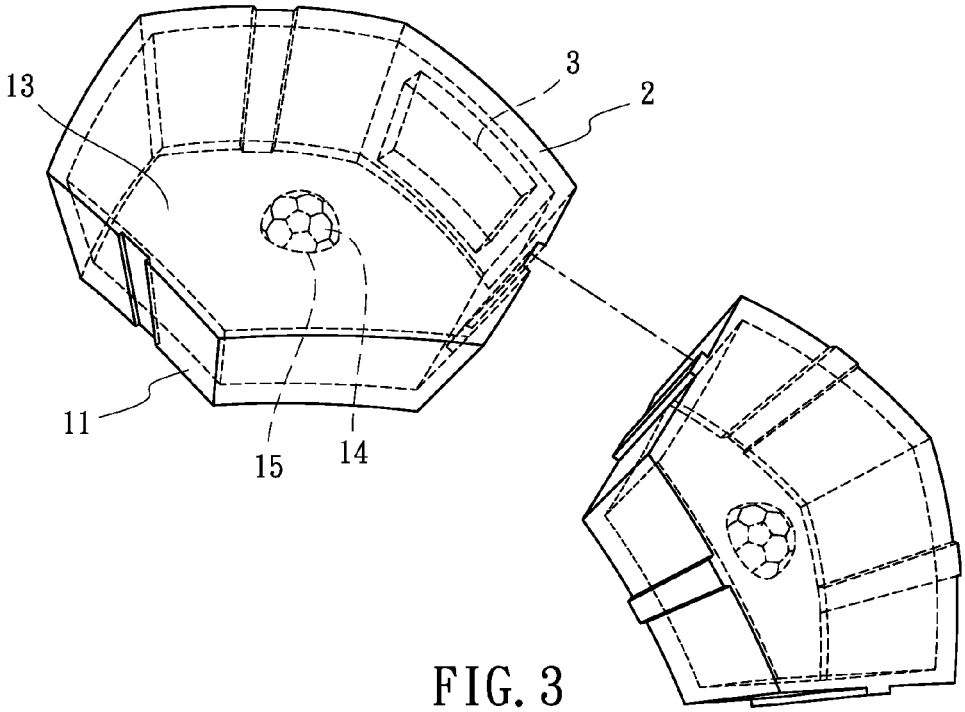
FIG. 3 is a perspective view for showing the structure of a block.
Figure 4:
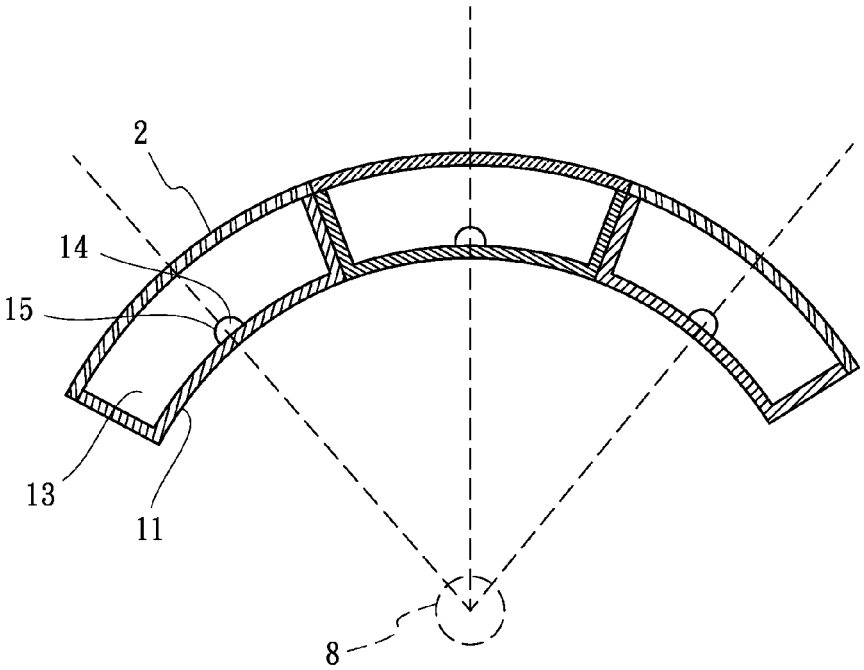
FIG. 4 is a cross-sectional view of part of a body for showing a plurality of light beams and a virtual image.

Referring to FIGS. 1-4, an atmosphere light with interacting functions in accordance with the present invention comprises a body 1, a plurality of lenses 2 and a controller 3. The body 1 is formed with a plurality of polygon-shaped blocks 11 which are connected to each other. The lenses 2 are respectively covering the blocks 11. Between each pair of block 11 and lens 2 have a receiving space 13 defined therein. A light source 14 is located in the receiving space 13. The light source 14 is mounted at the center on the bottom of the block 11. A cover 15 is assembled in the receiving space 13 and is covering the light source 14. The controller 3 is assembled in the body 1. The controller 3 is electrically connected to the light source 14 so that the light source 14 is varied by the controller 3. Under this arrangement, when the plurality of light beams from the light source 14 is transmitted to the lenses 2, the plurality of light beams is refracted by the lenses 2 and passes through the lenses 2. Consequently, the plurality of light beams is formed as a virtual image 8 at the center of the body 1 via the refraction.

Figure 5:
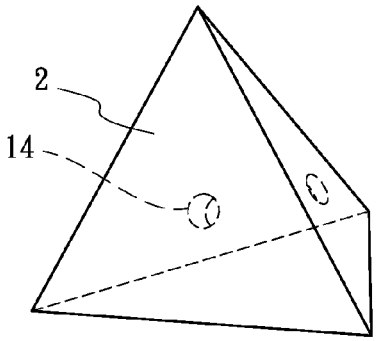
FIG. 5 is a perspective view of the second embodiment of the present invention.
Figure 6:
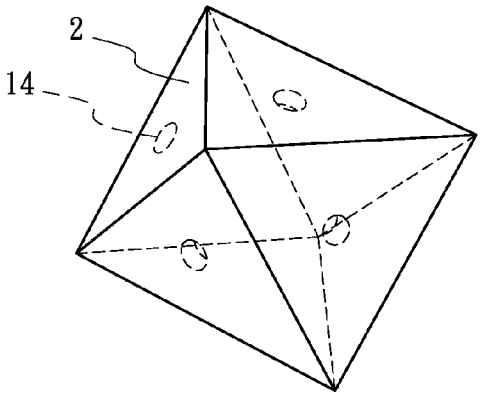
FIG. 6 is a perspective view of the third embodiment of the present invention.
Figure 7:
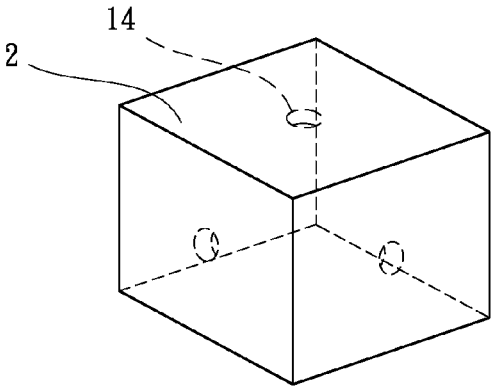
FIG. 7 is a perspective view of the fourth embodiment of the present invention.

The lenses 2 allows the light to transmit without impediment so that the lenses 2 can be replaced by convex lenses, concave lenses, combination of convex and concave lenses, transparent plastics or thin papers. Referring to FIGS. 5-7, the body 1 might be tetrahedron-shaped, octahedron-shaped or buckyball. Referring to FIG. 1, the body 1 is a buckyball. The surface of the body 1 is formed by twenty pieces of hexagon-shaped lenses 2 connected to twelve pieces of pentagon-shaped lenses 2. In addition, the hexagon-shaped lenses 2 and the pentagon-shaped lenses 2 of the sphere-shaped body 1 might be replaced by triangle-shaped lenses 2 and square-shaped lenses 2.

The blocks 11 are formed as regular polygons with four sides to twenty sides. The blocks 11 are made of plastic, iron sheet or magnetic materials.

The light sources 14 might be LEDs, fluorescent lamps or bulbs with different colors and might be the combination of the above light sources so that the light source 14 transmits the light beams with various colors and the body 1 performs in various colors.

Figure 11:
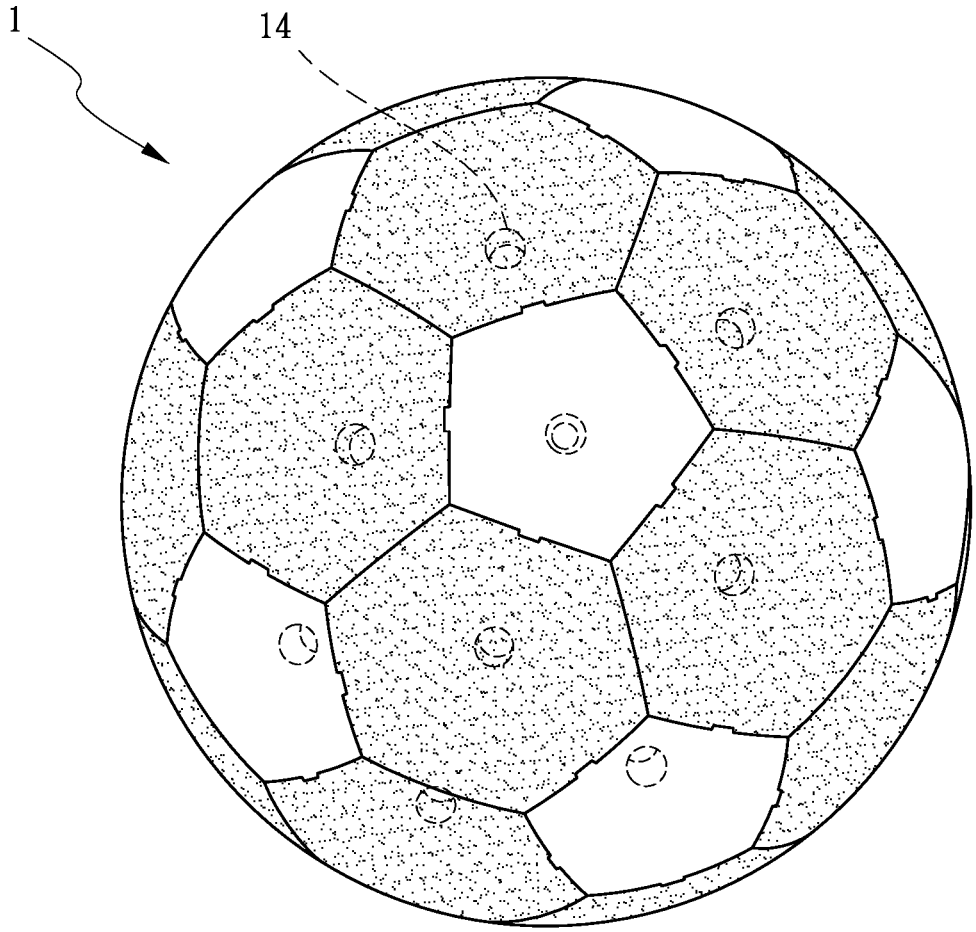
FIGS. 11-13 are the perspective views for showing different performances of the colors of a light source.
Figure 12:
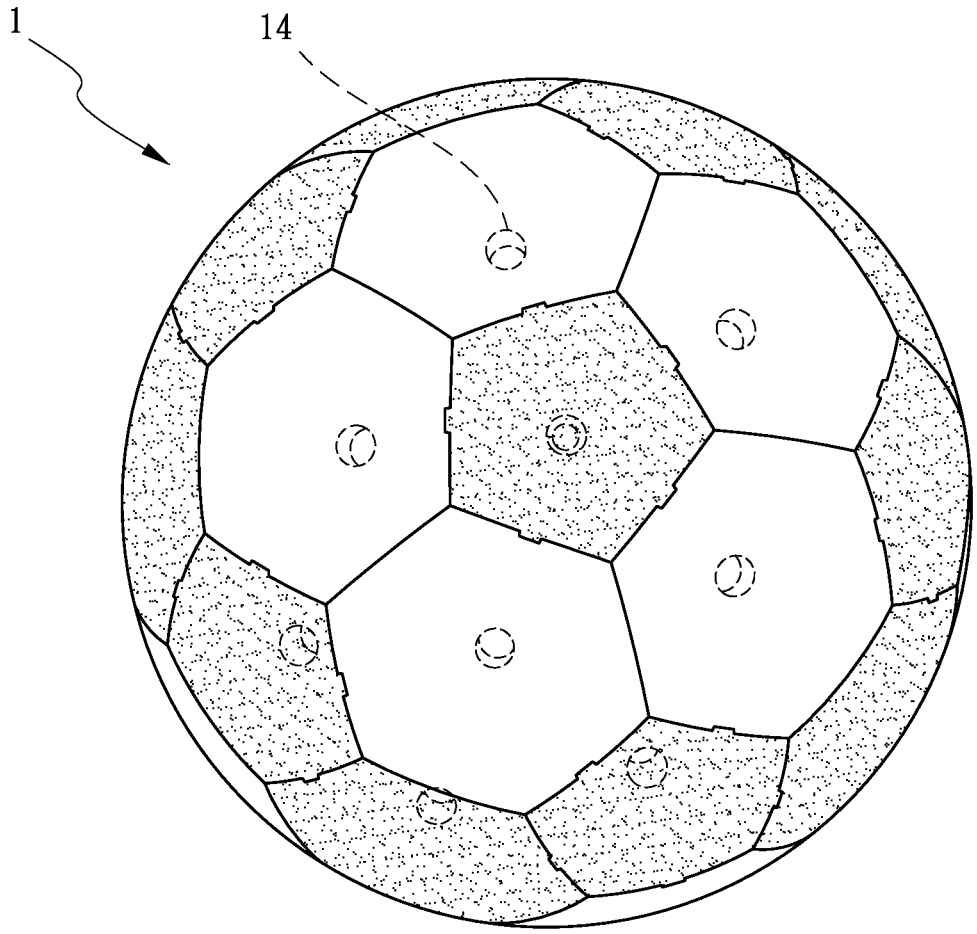
Figure 13:
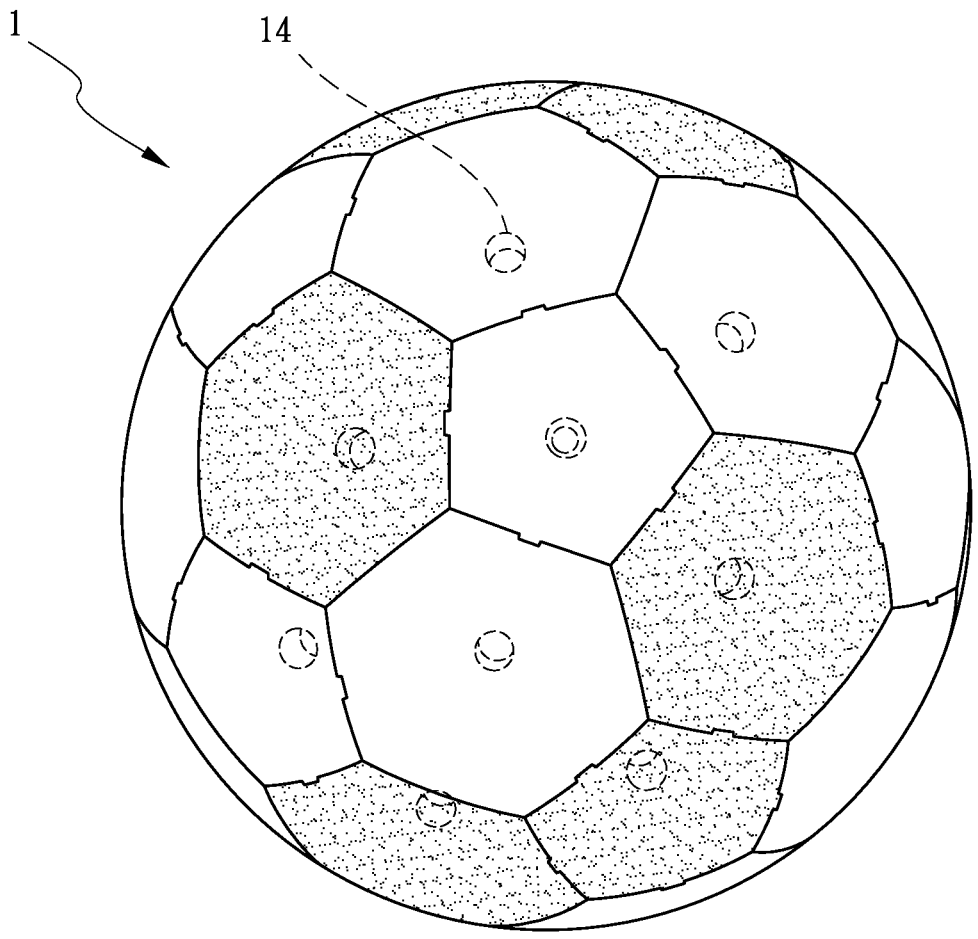

A plurality of programs is written into the controller 3 for controlling the light source 14 such as transmitting the light beams or not, changing the color of the light beams or adjusting the illumination of the light beams, so that the light source 14 transmits the light beams in various ways. The controller 3 might control the light source 14 via a switch, a remote controller, a voice-identified controller, an applause controller or a wire controller. The arrangement for the colors of the light sources 14 of the body 1 varies with the various embodiments (as shown in FIGS. 11-13).

The cover 15 in the receiving space 13 might be a diffusing sheet, an acrylic sheet or a glass sheet so as to refract the light beams from the light source 14 by the refracting index corresponding to the cover 15.

Figure 8:
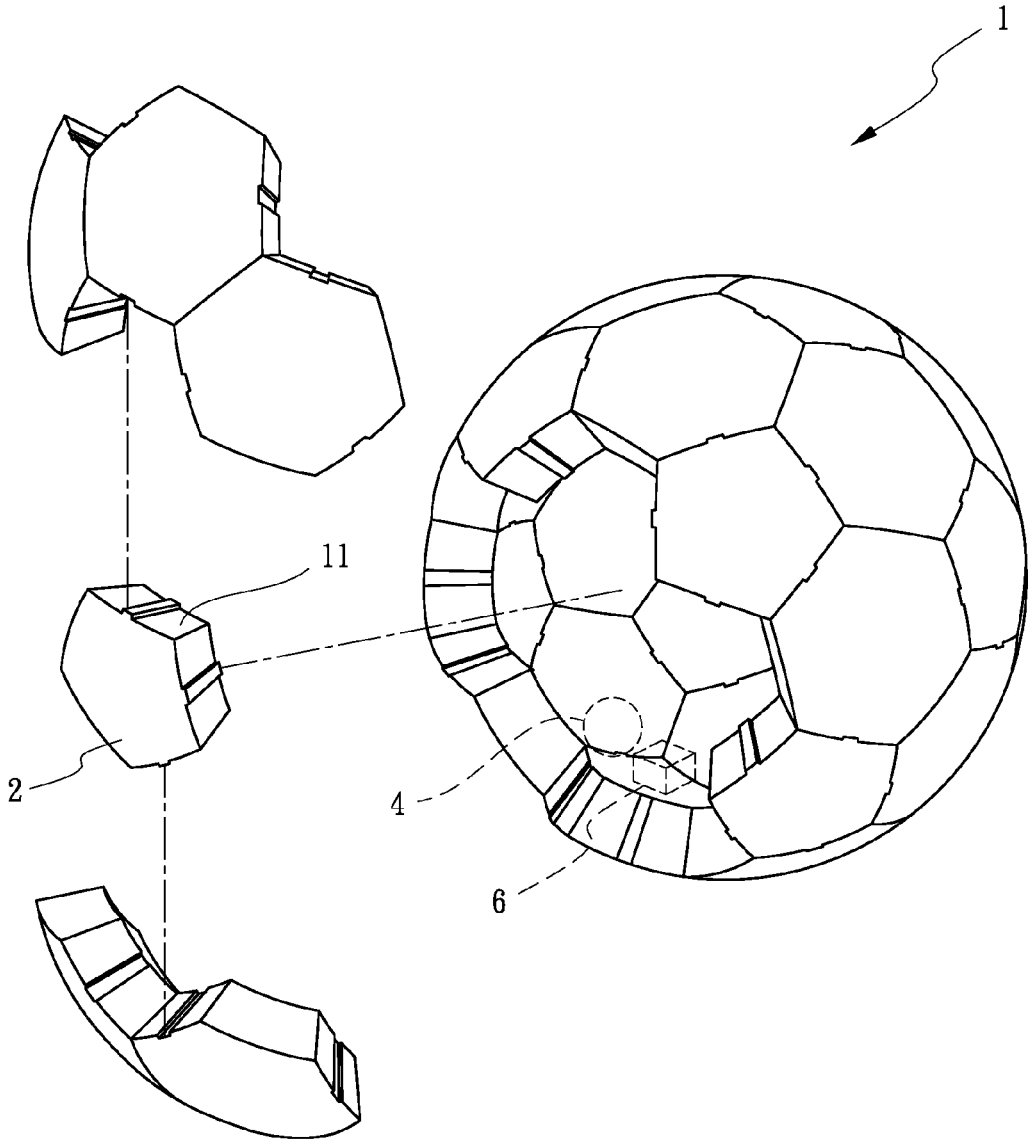
FIG. 8 is a perspective view for showing a microphone and a low-pass filter which are mounted in the atmosphere light with interacting functions.

Referring to FIG. 8, a microphone 4 is assembled in the body 1. The microphone 4 receives the outside voice and transmits the receiving message to the controller 3 so that the controller 3 controls the single light source 14 or the whole light sources 14 according to the outside voice. Therefore, the light beams from the light source 14 vary with the outside voice (such as transmitting the light beams or not, changing the color of the light beams, adjusting the illumination of the light beams or turn on/off the partial light sources 14). In addition, a low-pass filter 6 is mounted in the body 1. The outside ambience is filtered by the low-pass filter 6 so that the microphone 4 receives the clear voice command finally.

Figure 9:
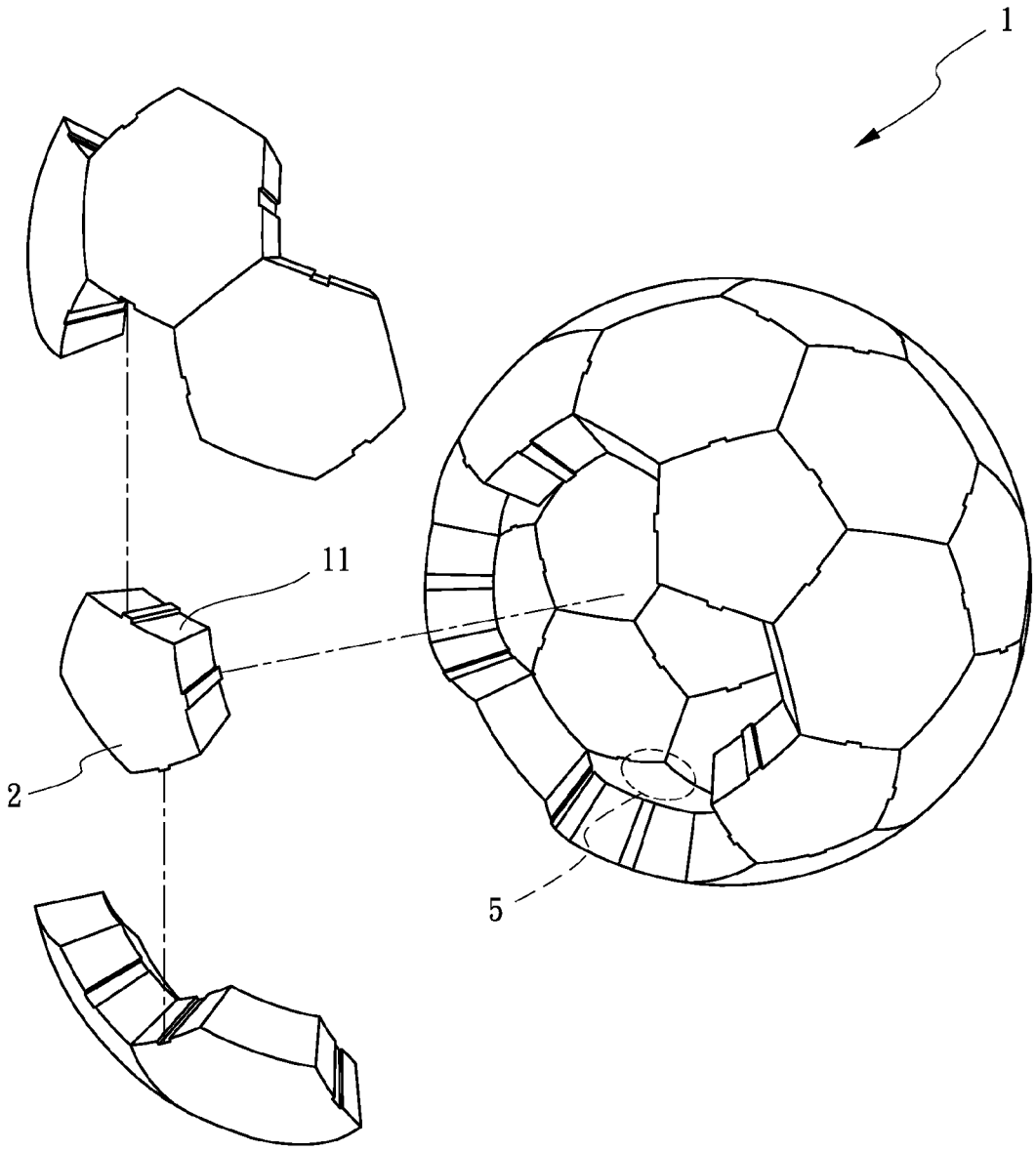
FIG. 9 is a perspective view for showing a shock sensor which is mounted in the atmosphere light with interacting functions.

Referring to FIG. 9, a shock sensor 5 is mounted in the body 1 instead of the microphone 4. The shock sensor 5 receives the outside shocks and transmits the received message to the controller 3 so that the controller 3 controls the single light source 14 or the whole light sources 14 according to the frequency or the amplitude of the outside shocks. Therefore, the light beams from the light source 14 vary with the outside shocks (such as transmitting the light beams or not, changing the color of the light beams, adjusting the illumination of the light beams or turn on/off the partial light sources 14).

Figure 10:
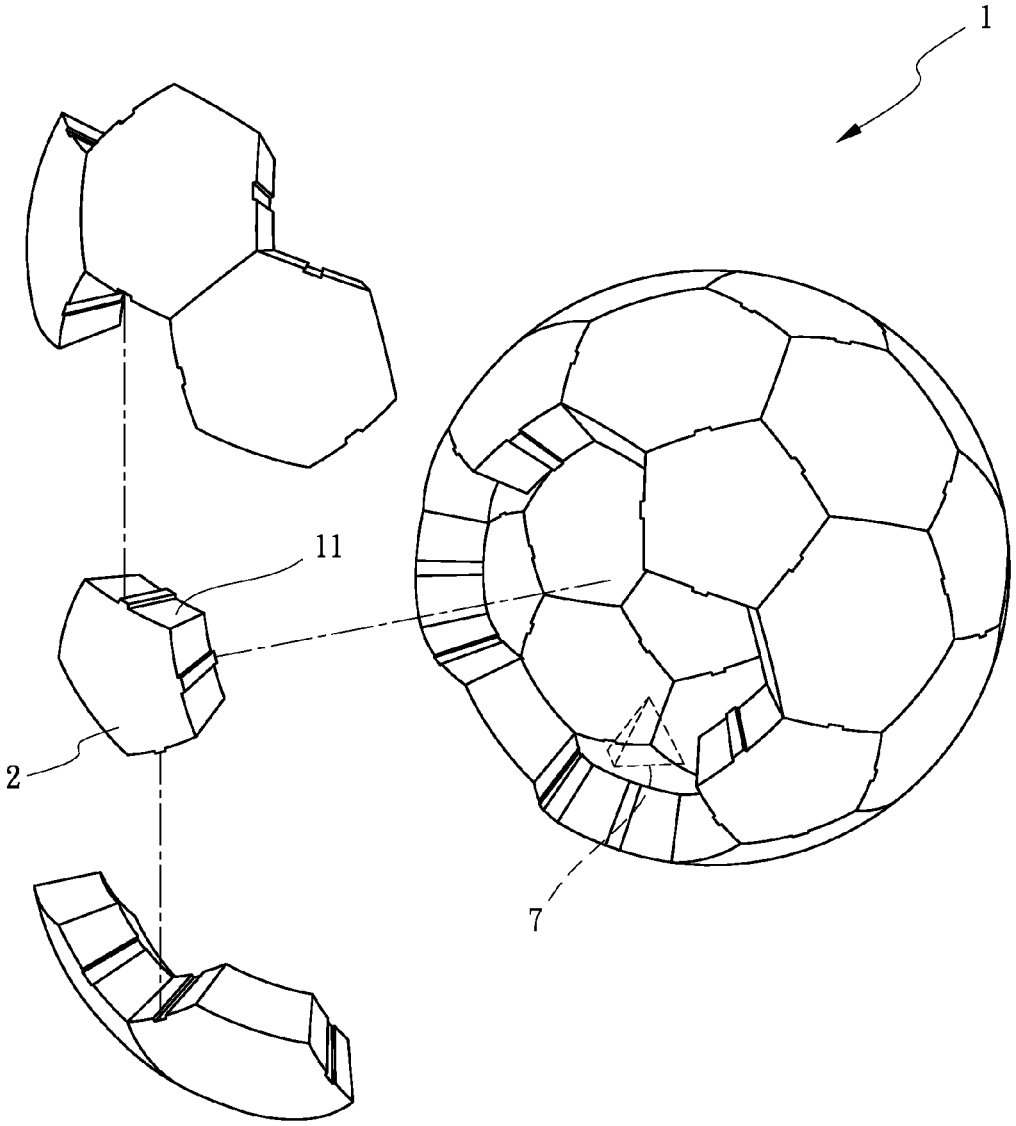
FIG. 10 is a perspective view for showing an ambient light photo sensor which is mounted in the atmosphere light with interacting functions.

Referring to FIG. 10, an ambient light photo sensor 7 is mounted in the body 1 instead of the microphone 4. When the user is close to the lenses 2 of the body 1, partial light is shaded by the user so that the ambient light photo sensor 7 receives an information about shadows and lights from the user and transmits the received message to the controller 3. Therefore, the controller 3 controls the single light source 14 or the whole light sources 14 according to the user closing to the lenses 2 of the body 1 or not. Therefore, the light beams from the light source 14 vary with the approach of the user (such as transmitting the light beams or not, changing the color of the light beams, adjusting the illumination of the light beams or turn on/off the partial light sources 14).

Furthermore, the programs written into the controller 3 for controlling the light source 14 are shown as following:

1. The whole light sources 14 might be turned on/off or the partial light sources 14 might be turned on/off.
2. The whole light sources 14 might be turned on/off with the time or the partial light sources 14 might be turned on/off with the time.
3. The colors of the light sources 14 are not the same from each other.
4. The colors of the light sources 14 are not the same from each other; and the whole light sources 14 might be turned on/off or the partial light sources 14 might be turned on/off.
5. The colors of the light sources 14 are variable with the time and are not the same from each other; the whole light sources 14 might be turned on/off or the partial light sources 14 might be turned on/off.
6. The illuminations of the light sources 14 are not the same from each other.
7. The illuminations of the light sources 14 are variable with the time and not the same from each other.
8. The illuminations of the light sources 14 are not the same from each other; the whole light sources 14 might be turned on/off or the partial light sources 14 might be turned on/off.
9. The illuminations of the light sources 14 are not the same from each other; the colors of the light sources 14 are not the same from each other.
10. The illuminations of the light sources 14 are not the same from each other; the colors of the light sources 14 are not the same from each other; the whole light sources 14 might be turned on/off or the partial light sources 14 might be turned on/off.
11. The illuminations of the light sources 14 are variable with the time and not the same from each other; the colors of the light sources 14 are not the same from each other; the whole light sources 14 might be turned on/off or the partial light sources 14 might be turned on/off.
12. The arrangement for the colors or the illuminations of the light sources 14 of the body 1 is performing as a football pattern (not shown). Under this arrangement, the light sources 14 of the pentagon-shaped blocks 11 has the same color and illumination from each other; the light sources 14 of the hexagon-shaped blocks 11 has the same color and illumination from each other or has different color and illumination from each other.
13. The arrangement for the illuminations of the light sources 14 of the body 1 is that a plurality of the light sources 14 is arranged as two groups and the two groups of the light sources 14 are alternately turned on with higher illumination (the plurality of the light sources 14 might be respectively corresponding to the pentagon-shaped lenses 2); the light sources 14 without higher illumination are turned on with lower illumination.

14. The arrangement for the illuminations of the light sources 14 of the body 1 is that the light sources 14 are turned on with higher illumination one by one and the light sources 14 without higher illumination are turned on with lower illumination.

15. The arrangement for the colors or the illuminations of the light sources 14 of the body 1 is that the body 1 has a front side and a rear side; each side has a center (not shown); the colors or the illuminations of the light sources 14 change with the time, and the light sources 14 with the same distance to the center have the same color and illumination from each other; the illumination of the front side and the rear side is expanding from the center, or contracting to the center, or one side expanding from the center and another side contracting to the center.

16. The arrangement for the colors of the light sources 14 of the body 1 is that one (or several) of the light sources 14 and other light source 14 (or light sources 14) which is (or are) adjacent to one (or several) of the light sources 14 are alternately turned on with white color; the light sources 14 without white color are always turned on with other constant color.

17. The arrangement for the colors and the illuminations of the light sources 14 of the body 1 is that the light sources 14 under the hexagon-shaped lenses 2 which are adjacent to one pentagon-shaped lens 2 are turned on with the same colors and illuminations (like a Chinese plum as shown in FIGS. 11-12); the arrangement might appear at one site (or two sites) of the body 1; the site (or sites) of the arrangement (or arrangements) might vary with the time.

Although the invention has been explained in relation to its preferred embodiment, it is to be understood that many other possible modifications and variations can be made without departing from the spirit and scope of the invention as hereinafter claimed.

What is claimed is:

1. An atmosphere light with interacting functions comprising:

a body formed with a plurality of polygon-shaped blocks which are connected to each other;

a plurality of lenses respectively covering the blocks, between each pair of block and lens having a receiving space defined therein, a light source located in the receiving space, the light source mounted at a center of a bottom of the block, a cover assembled in the receiving space and covering the light source; and a controller assembled in the body, the controller electrically connected to the light source so that the light source is varied by the controller;

wherein, when the plurality of light beams from the light sources is transmitted to the lenses, the light beams are refracted by the lenses and pass through the lenses in such a way that each of the light sources has a same virtual image at a center of the body; the light source is further controlled by the controller so that the light source transmits the light beams in various ways according to the controller.

2. The atmosphere light with interacting functions as claimed in claim 1, wherein the lenses allows the light to transmit without impediment so that the lenses can be replaced by convex lenses, concave lenses, combination of convex and concave lenses, transparent plastics or thin papers.

3. The atmosphere light with interacting functions as claimed in claim 1, wherein the body might be tetrahedron-shaped, octahedron-shaped or buckyball.

4. The atmosphere light with interacting functions as claimed in claim 1, wherein the blocks are formed as regular polygons with four sides to twenty sides.

5. The atmosphere light with interacting functions as claimed in claim 1, wherein the blocks are made of plastic, iron sheet or magnetic materials.

6. The atmosphere light with interacting functions as claimed in claim 1, wherein the light sources might be LEDs, fluorescent lamps or bulbs.

7. The atmosphere light with interacting functions as claimed in claim 1, wherein the controller might control the light source via a switch, a remote controller, a voice-identified controller, an applause controller or a wire controller so as to vary the light beams from the light sources.

8. The atmosphere light with interacting functions as claimed in claim 1, wherein a microphone is assembled in the body; the microphone receives the outside voice and transmits the receiving message to the controller so that the controller controls the light sources according to the outside voice.

9. The atmosphere light with interacting functions as claimed in claim 1, wherein a low-pass filter is mounted in the body; the outside ambience is filtered by the low-pass filter so that the microphone receives the clear voice command finally.

10. The atmosphere light with interacting functions as claimed in claim 1, wherein a shock sensor is mounted in the body; the shock sensor receives the outside shocks and transmits the received message to the controller so that the controller controls the light sources according to the frequency or the amplitude of the outside shocks.

11. The atmosphere light with interacting functions as claimed in claim 1, wherein an ambient light photo sensor is mounted in the body; when the user is close to the lenses of the body, partial light is shaded by the user so that the ambient light photo sensor receives an information about shadows and lights from the user and transmits the received message to the controller; therefore, the controller controls the single light sources according to the user closing to the lenses of the body or not.

12. The atmosphere light with interacting functions as claimed in claim 1, wherein the cover in the receiving space might be a diffusing sheet, an acrylic sheet or a glass sheet.

* * * * *